US011174875B1

(12) United States Patent
Goodjohn et al.

(10) Patent No.: US 11,174,875 B1
(45) Date of Patent: Nov. 16, 2021

(54) NOISE CANCELLATION OF A DOMESTIC APPLIANCE USING A MOTOR CONTROL

(71) Applicant: Haier US Appliance Solutions, Inc., Wilmington, DE (US)

(72) Inventors: Paul Goodjohn, Crestwood, KY (US); Joseph Wilson Latham, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/097,154

(22) Filed: Nov. 13, 2020

(51) Int. Cl.
*F04D 29/66* (2006.01)

(52) U.S. Cl.
CPC ..... *F04D 29/665* (2013.01); *F04D 29/667* (2013.01); *G10K 2210/1054* (2013.01)

(58) Field of Classification Search
CPC ..... G10K 2210/1054; F04D 29/665; F04D 29/667
USPC ..... 381/71.3
See application file for complete search history.

(56) References Cited

U.S. PATENT DOCUMENTS 8,855,329 B2 10/2014 Slapak et al.
9,091,280 B2 7/2015 Hopkins
9,380,382 B2 * 6/2016 Hopkins ..... F04D 29/665

FOREIGN PATENT DOCUMENTS

EP 3001560 A2 3/2016

* cited by examiner

*Primary Examiner* — Paul Kim
(74) *Attorney, Agent, or Firm* — Dority & Manning, P.A.

(57) ABSTRACT

A method of operating a motor driving a rotating member includes directing rotation of the rotating member at the motor at an initial speed, determining a first frequency of a first noise component generated by the rotating member at the initial speed, determining a second noise component having a second frequency phase shifted 180° with respect to the first frequency, determining a torque modifier of the motor to generate the second noise component from the motor, and directing activation of the motor according to the determined torque modifier.

18 Claims, 3 Drawing Sheets

NOISE CANCELLATION OF A DOMESTIC APPLIANCE USING A MOTOR CONTROL

FIELD OF THE INVENTION

The present subject matter relates generally to noise cancellation for a domestic appliance, and more particularly to controlling motor operation of a domestic appliance to cancel noise.

BACKGROUND OF THE INVENTION

Certain domestic appliances (e.g., air conditioning appliances, refrigerator appliances, oven appliances, dishwashing appliances, washing machine appliances, dryer appliances, range hoods, etc.) exist that provide convenience and comfort to users. These appliances may include motors that rotate at high speeds. These motors in turn deliver rotational energy to rotating members (e.g., fans) which produce air flow that is useful in many situations. For example, these rotating members can be used to motivate air through ducts, to provide cooling comfort to users, or the like. During operation, these rotating members may produce noise caused by rapidly moving through air, which may be unpleasant to users and bystanders.

Attempts have been made to mask or cancel out noise generated by an appliance motor by using sound (e.g., anti-noise signals) in a phase opposite of the phase of the noise. Generally, sound sources, such as speakers, are required to transmit such sounds. Often, the sound sources require especially large components or diaphragms in order to generate sound of the appropriate frequency. Such components naturally either increase the overall size of a consumer appliance, reduce the amount of available usable space for the consumer appliance, or both. Moreover, these components may increase material costs and complexity for assembly. Furthermore, it is often difficult to know or determine the correct frequency or frequencies at which a noise canceling sound should be projected.

Therefore, it would be useful to provide a domestic appliance configured to address one or more of the above identified issues. In particular, it may be advantageous to provide a domestic appliance having features to generate noise cancellation without additional components (e.g., dedicated speakers).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a motor driving a rotating member is provided. The method may include directing rotation of the rotating member at the motor at an initial speed, determining a first frequency of a first noise component generated by the rotating member at the initial speed, determining a second noise component having a second frequency phase shifted 180° with respect to the first frequency, determining a torque modifier of the motor to generate the second noise component from the motor, and directing activation of the motor according to the determined torque modifier.

In another exemplary aspect of the present disclosure, a motor assembly of a domestic appliance is provided. The motor assembly may include a motor, a rotating member in mechanical communication with the motor and rotated thereby, a microphone for monitoring sound generated during operation of the domestic appliance, and a controller operably coupled to the microphone and the motor. The controller may be configured to initiate a noise-responsive operation including directing rotation of the rotating member at the motor at an initial speed, determining a first frequency of a first noise component generated by the rotating member at the initial speed, determining a second noise component having a second frequency phase shifted 180° with respect to the first frequency, determining a torque modifier of the motor to generate the second noise component from the motor, and directing activation of the motor according to the determined torque modifier.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
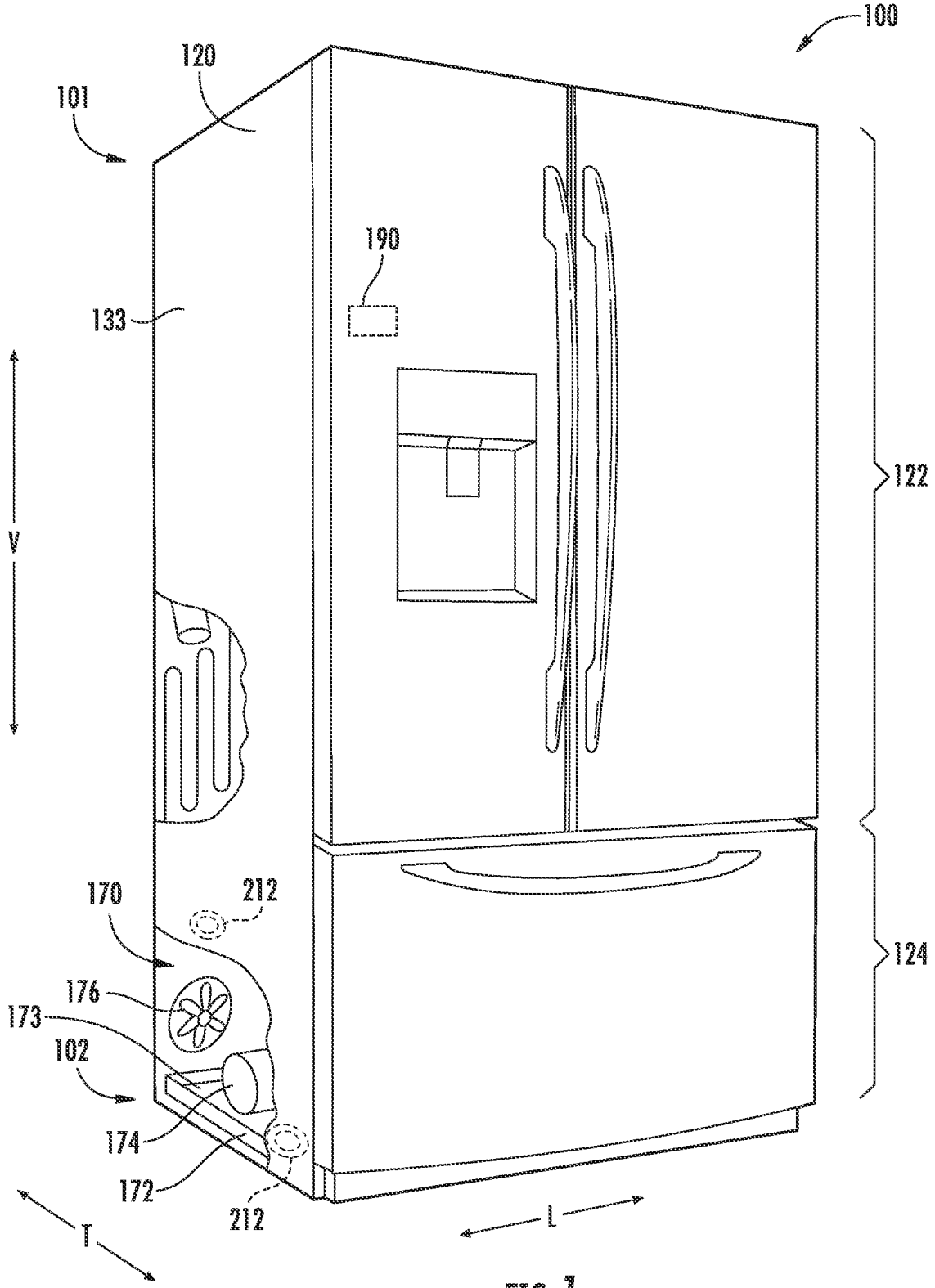
FIG. 1 provides a perspective view of a domestic appliance, specifically a refrigerator appliance, according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Generally, some aspects of the present disclosure provide a domestic appliance (e.g., air conditioning appliance, refrigerator appliance, oven appliance, dishwashing appliance, washing machine appliance, dryer appliance, range hood, etc.) that has a motor and a rotating member (e.g., a fan). One or both of the motor and rotating member may be mounted within a cabinet of the domestic appliance. During use, noise may be detected at the rotating member, and the motor may generate an anti-noise wave to mask or cancel out the detected noise.

Turning now to the figures, FIG. 1 provides a front, perspective view of a consumer appliance 100 according to exemplary embodiments of the present disclosure. Appliance 100 may include a cabinet or housing 120 that extends between a top portion 101 and a bottom portion 102 along a vertical direction V. A lateral direction L and a transverse direction T are also defined by the cabinet 120 to define a mutually-orthogonal direction system with the vertical direction V. As shown, cabinet 120 includes or is formed by one or more exterior panels (e.g., body panels 133) mounted. When assembled, the body panels 133 define an interior of the cabinet 120. Within the interior, cabinet 120 defines one or more internal chambers. For example, as shown in the exemplary appliance 100 of FIG. 1, cabinet 120 may define one or more chilled chambers for receipt of food items for storage. In certain embodiments, housing 120 defines fresh food chamber 122 positioned at or adjacent to top portion 101 of housing 120 and a freezer chamber 124 arranged at or adjacent to bottom portion 102 of housing 120. As such, appliance 100 may be referred to as a bottom mount refrigerator.

However, as will be understood by those skilled in the art, appliance 100 is provided by way of example only, and the present subject matter may be used in any suitable domestic appliance (e.g., air conditioning appliance, oven appliance, dishwashing appliance, washing machine appliance, dryer appliance, range hood, etc.). Additionally or alternatively, the present subject matter may be used in personal fans such as box fans, ceiling fans, handheld fans, and the like. Thus, the exemplary embodiments illustrated in the figures are not intended to limit the present subject matter to any particular appliance, configuration, or arrangement, except as otherwise indicated.

In some embodiments, a mechanical compartment 170 is defined by housing 120 (e.g., at bottom portion 102 of housing 120, spaced apart from chamber 122 or 124). Optionally, a drain pan 172 may be positioned within mechanical compartment 170. In some such embodiments, drain pain 172 is formed from one or more planar, metal pan panels 173. Liquid or water from one or more portions of the refrigerator appliance 100 may collect within the drain pan 172. Additionally or alternatively, one or more portions of a sealed cooling system may be provided on or near drain pan 172. When assembled, a compressor 174 or condenser (not pictured) of the sealed system can be positioned, for example, on or adjacent to drain pan 172. In some such embodiments, heat from condenser can assist with evaporation of liquid water in drain pan 172. A fan 176 may be configured for cooling compressor 174 or condenser, and can also direct a flow air across or into drain pan 172. Thus, fan 176 can be positioned on or adjacent to drain pan 172. Additionally or alternatively, an evaporator 178 in fluid communication with compressor 174 may be mounted on or within cabinet 120 above the drain pan 172. Drain pan 172 may be sized and shaped for facilitating evaporation of liquid water therein. For example, drain pan 172 may be open-topped and extend across about a width or a depth of housing 120.

Figure 3:
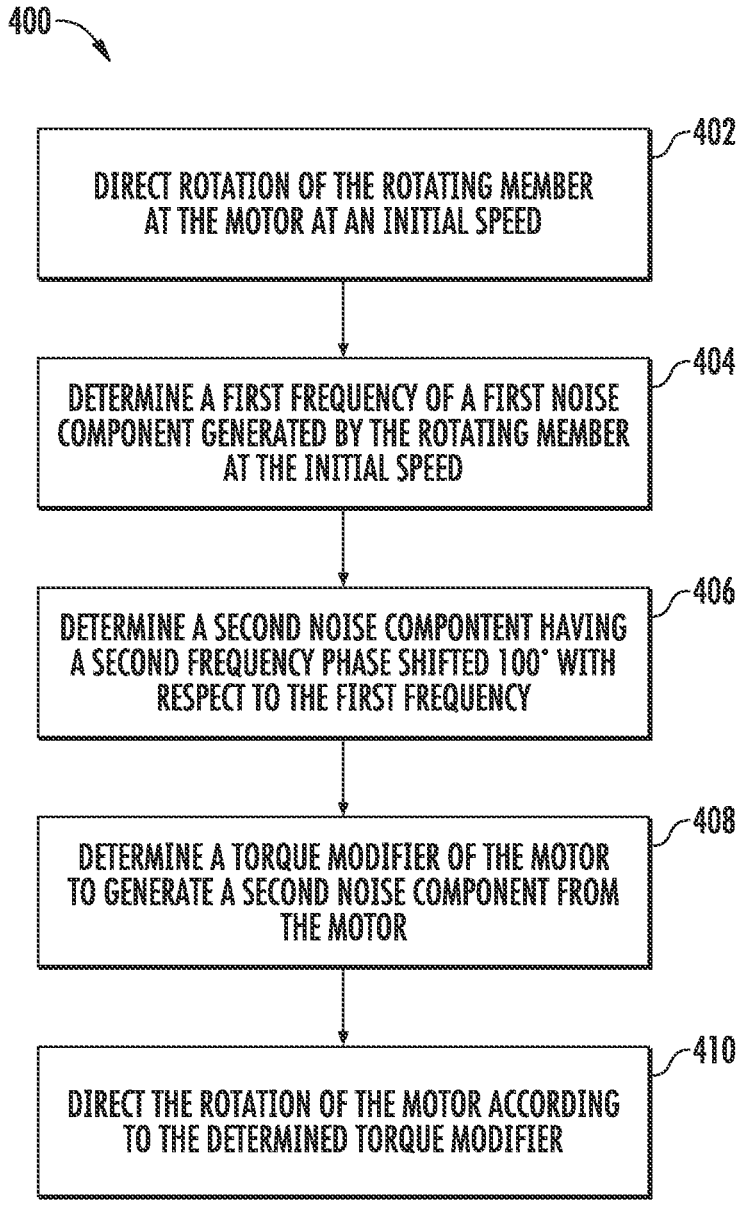
FIG. 3 is a schematic side view of an exemplary fan motor and fan according to an embodiment of the present disclosure.

In detail, fan 176 may be driven by a fan motor 180 (FIG. 3). Fan motor 180 may be a synchronous motor, for example. In detail, fan motor 180 may be a three-phase synchronous alternating current (AC) motor. Fan motor 180 may be controlled using a vector controller and a three-phase inverter (e.g., included with a controller 190). Accordingly, a voltage output to fan motor 180 may be rapidly adjusted (e.g., up to 16,000 times per second). These rapid voltage adjustments may be modulated to induce vibrations in fan motor 180. Subsequently, a sound output or noise component may be generated by fan motor 180.

Figure 2:
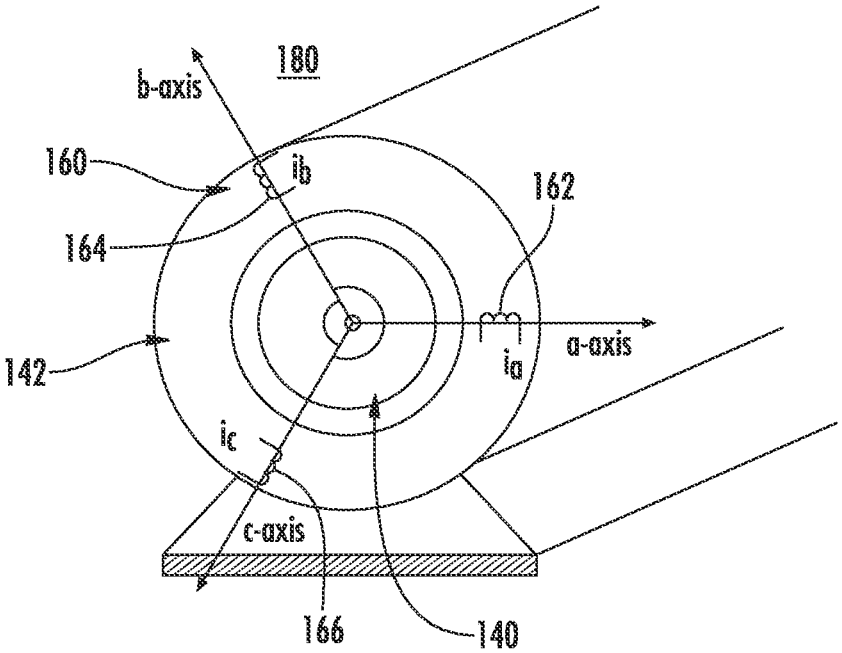
FIG. 2 is a schematic view of an exemplary motor according to an embodiment of the present subject matter.

Referring now to FIG. 2, in optional embodiments, fan motor 180 is provided as or includes a synchronous motor. For instance, fan motor 180 may include a stator 142 that includes three-phase windings 144 placed approximately 120° apart physically around a rotor 140. It should be appreciated that as used herein, terms of approximation, such as "approximately," "substantially," or "about," refer to being within a ten percent margin of error.

During operation, windings 160 work together to generate three-phase currents which generated a rotating magnetic field. Specifically, the magnetic fields generated by first phase winding 162, second phase winding 164, and third phase winding 166 can be summed to generate the stator magnetic field which for phase currents of constant sinusoidal amplitude has a constant magnitude and rotates at the input frequency. In addition, rotor 140 may be magnetized to generate a rotor magnetic field which interacts with the stator magnetic field such that rotor 140 rotates at substantially the same speed as the stator magnetic field. According to exemplary embodiments, the magnetization of rotor 140 is produced by a permanent magnet in brushless designs or by windings, with a DC current supplied through slip rings or brushes, or in any other suitable manner. Thus, when stator 142 is energized with the appropriate power, rotor 140 is caused to rotate while stator 142 remains fixed.

Although the models used herein are developed for a synchronous motor, it should be appreciated that aspects of the present subject matter may also applied to other types of motors. For example, similar mathematical modeling of the mechanical dynamics associated with other motor types and configurations may be used. Thus, fan motor 180 is used herein only as an exemplary embodiment for the purpose of illustration and is not intended to limit the scope of the present subject matter in any manner.

Referring generally to FIGS. 1 through 3, operation of fan motor 180 may be controlled by a controller or processing device 190 that is operatively coupled to fan motor 180 for regulating operation of fan motor 180. Specifically, controller 190 is in operative communication with fan motor 180 and may selectively energize stator 142 to drive rotor 140 as described above. Controller 190 may be located within cabinet 120. In some examples, controller 190 is provided within fan motor 180. Thus, controller 190 may generally be configured for executing selected methods of operating fan motor 180, e.g., as described herein. As described in more detail below, controller 190 may include a memory and microprocessor, such as a general or special purpose microprocessor operable to execute programming instructions or micro-control code associated with methods described herein. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Fan motor 180 may be in communication with controller 190 via one or more signal lines or shared communication busses.

Turning especially to FIG. 3, a side schematic view is provided of a fan assembly (e.g., for fan 176) in isolation. In some embodiments, fan 176 and fan motor 180 are coaxial. For instance, a rotational axis of fan motor 180 may be coaxial with a rotational axis of fan 176 (e.g., as shown in FIG. 3). As shown, controller 190 is in operable (e.g., wired or wireless) communication with fan motor 180 and one or more electromechanical receivers 212). In some embodiments, controller 190 is configured to initiate a noise canceling operation that generally provides for canceling one or more detected noises. For instance, the noise canceling operation may include receiving a noise input signal (e.g., from an audible noise detected at the controller 190 via one or more electromechanical receivers 212) and initiating an anti-noise wave 220 at the fan motor 180. In other words, controller 190 may send a signal to fan motor 180 to operate at a predefined operation or activation pattern in order to generate a specific anti-noise wave 220 according to the detected noise, which will be explained in more detail below. Advantageously, fan motor 180 may generate a noise cancellation sound wave while driving fan 176, reducing the need for extra parts (e.g., speakers).

In some embodiments, the noise input signal may correspond to a soundwave 222 emitted from an internal component of the appliance 100 (FIG. 1). In other words, the detected soundwave 222 may be generated within the interior of the cabinet 120 (e.g., from a compressor 174, fan 176, etc.). Thus, the noise input signal may be an internal vibration noise signal corresponding to a soundwave 222 within an interior of the cabinet 120.

As shown, for instance at FIG. 3, the initiated anti-noise wave 220 may be emitted or propagated from vibrations induced at fan motor 180. Generally, the anti-noise wave 220 may be of the same amplitude as the soundwave 222 corresponding to the noise input signal, but of an inverted phase. Thus, the anti-noise wave 220 may cause destructive interference of the original soundwave 222, as is understood.

In additional or alternative embodiments, one or more electromechanical receivers 212 may be mounted within the cabinet 120. Generally, electromechanical receiver 212 is configured for converting one or more received soundwaves 222 or vibrations to one or more electrical signals (e.g., noise input signal). In some embodiments, an electromechanical receiver 212 is included as part of a self-contained microphone assembly (e.g., dynamic microphone, ribbon microphone, fiber-optic microphone, piezoelectric microphone, etc.). In additional or alternative embodiments, an electromechanical receiver 212 may be fixed to fan motor 180. As an example, electromechanical receiver 212 may include an induction coil positioned coaxial to a permanent magnet, similar to that found within a dynamic microphone. When fixed to a corresponding element, electromechanical receiver 212 may vibrate with at least a portion of the corresponding element. Thus, the corresponding element may act as a diaphragm for receiving soundwaves 222 which may then be detected as one or more corresponding electrical signals at the electromechanical receiver 212.

Figure 4:
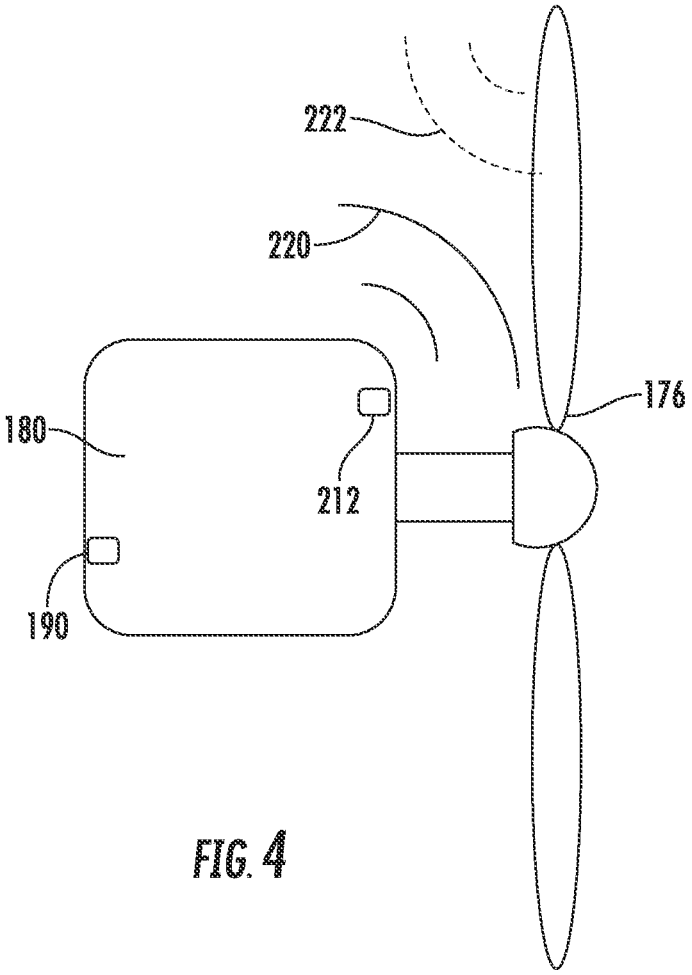
FIG. 4 is a flow chart depicting a method operating a rotating member according to an exemplary embodiment of the present disclosure.

Referring to FIG. 4, a method 400 of operating a motor (e.g., fan motor 180) will be described. At step 402, the method 400 may include directing rotation of a rotating member (e.g., fan) at a motor (e.g., fan motor) at an initial speed [e.g., rotational speed, such as in rotations per minute (RPM)]. A controller may send a signal to the motor to operate at a predetermined speed (or voltage). For instance, when a user selects a speed (e.g., a rotational speed of the fan, a desired output of air, a desired cooling level, etc.), the controller may calculate the required torque of the fan motor to provide the selected speed (or output). In turn, the controller may determine the required voltage (i.e., input voltage) to develop the required torque. The predetermined speed may be set or selected by a user (i.e., through a control panel) or determined automatically (e.g., based on the operational or cooling needs of the corresponding appliance). In the case of a handheld or personal fan, the user may select a desired speed for comfort.

In detail, the rotational speed of the fan motor may be controlled according to a first control loop [e.g., speed control loop, such as a field-oriented control (FOC) programmed within the controller, as would be understood]. The controller may calculate (or measure, e.g., via a sensor) a speed of the fan (or the fan motor) at regular intervals. The controller may then calculate and/or store the motor torque signal as a first requested motor torque signal corresponding to the initial speed. The calculated (or measured) speed may then be compared to the predetermined speed (or target speed). A difference between the target speed and the measured speed may be stored as a speed error signal, from which the controller calculates a requested torque change [e.g., according to a proportional-integral (PI) control scheme, as would be understood]. The requested torque change may then be output as a torque change signal to achieve the requested torque (e.g., a torque change to the first requested motor torque signal). In some embodiments, the torque change signal is low frequency and direct current (DC). The first control loop may then adapt the torque change signal to achieve the requested torque. Accordingly, the speed of the fan motor (and subsequently the fan) may be monitored and maintained at or near the predetermined (target) speed.

At step 404, the method 400 may include determining a first frequency of a first noise component generated by the rotating member at the initial speed. For instance, a microphone (e.g., electromechanical receiver) may record a first noise component (e.g., as a noise input signal) emitted by the rotating member while the rotating member rotates at the initial speed. As mentioned above, the microphone may be provided near the rotating member so as to detect or record an accurate noise sample. The detected noise sample (e.g., at a particular point in time or period of operation) may thus be established as the first noise component. The microphone may then transmit the first noise component to the controller to be analyzed and converted to a noise input signal. For example, the first noise component may be converted to a sinusoidal noise input signal having a first frequency. The controller may then determine the first frequency of the noise input signal.

At step 406, the method 400 may include determining a second frequency that is phase shifted 180° with respect to the first frequency. For instance, the controller may be programmed with a target noise output of zero (e.g., no noise, or silence). The target noise output may then be subtracted by the first noise component, which results in a negative of the first noise component. Thus, the controller may determine that the second frequency of a noise output signal should be identical to the first frequency, but phase shifted by 180°. Accordingly, the second frequency may be referred to as a noise error signal. As described above, the phase shifting of the noise output signal creates a destructive wave pattern to cancel out the first noise component generated by the rotating member.

At step 408, the method 400 may include determining a torque modifier of the motor to generate a second noise component from the motor having the second frequency. For instance, the controller may establish a second control loop (noise control loop) parallel to the first control loop. The second control loop may determine a noise error factor as calculated from the first noise component. Subsequently, the second control loop may generate a torque signal to be applied to the motor in order to generate the noise error factor. Although the second control loop may be parallel to the first control loop, the second control loop may generate torque signals related to creating a noise cancellation effect, while the first control loop may generate torque signals related to maintaining the rotating member at the desired speed. For example, the controller calculates the noise error factor required to generate a noise component having the second frequency. In particular, as mentioned above, the noise error signal may be the negative of the first noise component. The controller may then generate a new torque signal (new motor torque signal) to send to the motor to alter the input voltage such that the motor generates the second noise component having the second frequency.

In certain embodiments, the controller may include a torque-to-noise transfer function model (e.g., programmed within the controller) of the fan motor and the fan (i.e., operating as a system). Upon determining the desired second noise component including the second frequency (e.g., a frequency equal to the first frequency phase-shifted by 180°), the controller may determine the adjustment needed to the fan motor to produce the second noise component. For instance, the controller may use the inverse of the torque-to-noise transfer function in order to determine the required torque to generate the second noise component (e.g., the second noise component is applied to a model, lookup table, or chart of the torque-to-noise transfer function programmed within the controller to output a required torque based on a second noise component value). The required torque for the second noise component may be high frequency and purely alternating current (AC). This may be calculated within the second control loop. Consequently, the controller calculates the needed adjustment to the fan motor (i.e., in terms of torque, voltage input, rotational speed, etc.).

At step 410, the method may include directing the rotation of the motor according to the determined torque modifier. The controller may then send the torque signal calculated using the error factor and measured first frequency to the motor and alter a voltage input to the motor (e.g., from the initial input). For example, the new motor torque signal may be based off of the calculated second frequency (or calculated noise error signal), and may result in a modified requested torque signal based on the first requested motor torque signal and the new requested motor torque signal. As mentioned above, the second control loop may be a closed loop. Accordingly, the method 400 may be repeated throughout an operation of the rotating member (e.g., the fan or the fan motor).

The first control loop and the second control loop may share a control signal. In some embodiments, the control signal is the torque of the motor. For instance, in the case of synchronous motors, the first and second control loops may be parallel outer control loops. The outputs from the first and second control loops may be summed together and fed as a reference to an inner control loop (i.e., a control loop which may determine the voltage necessary to achieve the desired torque). In detail, the reference for the first and second control loops may be a current signal. The controller may then use current feedback to determine the desired torque and ensure the determined torque is accurate. Accordingly, the controller may further perform signal processing to differentiate and separate the low frequency DC torque signal of the first control loop from the high frequency AC torque signal of the second control loop. For instance, the first control loop signal may be fed through a low-pass filter in order to ignore any disturbance which may be created by the second control loop signal. In some embodiments, the second control loop signal is also run through a high-pass filter in order to ignore any disturbance which may be created by the first control loop signal. Advantageously, the second control loop may be regularly monitored in order to provide near constant motor changes, and in turn improve noise cancellation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a motor driving a rotating member, the method comprising:

directing rotation of the rotating member at the motor at an initial speed;

determining a first frequency of a first noise component generated by the rotating member at the initial speed;

determining a second noise component having a second frequency phase shifted 180° with respect to the first frequency;

determining a torque modifier of the motor to generate the second noise component from the motor; and directing activation of the motor according to the determined torque modifier.

2. The method of claim 1, wherein determining the torque modifier comprises generating a new requested motor torque signal to generate the second noise component from the motor.

3. The method of claim 2, wherein the directing activation of the motor according to the torque modifier comprises:

adjusting rotation of the motor based on the new requested motor torque signal.

4. The method of claim 3, wherein directing rotation of the rotating member comprises directing rotation of the motor according to a first requested motor torque signal corresponding to the initial speed, and wherein the adjusting rotation of the motor based on the new requested motor torque signal comprises generating a modified requested motor torque signal based on the first requested motor torque signal and the new requested motor torque signal.

5. The method of claim 2, wherein the determining the first frequency of the first noise component comprises detecting the first noise component at a microphone, the microphone being adjacent to the rotating member and in communication with the controller.

6. The method of claim 1, wherein directing the rotation of the motor comprises modulating voltage through the motor at a three-phase inverter.

7. The method of claim 4, wherein generating the modified motor torque signal comprises adding the first requested motor torque signal and the new requested motor torque signal.

8. The method of claim 1, wherein the motor and the rotating member are coaxial with each other.

9. The method of claim 1, wherein the rotating member is a fan.

10. A motor assembly of a domestic appliance, the motor assembly comprising:

a motor;

a rotating member in mechanical communication with the motor and rotated thereby;

a microphone for monitoring sound generated during operation of the domestic appliance; and a controller operably coupled to the microphone and the motor, the controller being configured to initiate a noise-responsive operation comprising directing rotation of the rotating member at the motor at an initial speed, determining a first frequency of a first noise component generated by the rotating member at the initial speed, determining a second noise component having a second frequency phase shifted 180° with respect to the first frequency, determining a torque modifier of the motor to generate the second noise component from the motor, and directing activation of the motor according to the determined torque modifier.

11. The motor assembly of claim 10, wherein determining the torque modifier comprises generating a new requested motor torque signal to generate the second noise component from the motor.

12. The motor assembly of claim 11, wherein the directing activation of the motor according to the torque modifier comprises:

adjusting rotation of the motor based on the new requested motor torque signal.

13. The motor assembly of claim 12, wherein directing rotation of the rotating member comprises directing rotation of the motor according to a first requested motor torque signal corresponding to the initial speed, and wherein the adjusting rotation of the motor based on the new requested motor torque signal comprises generating a modified requested motor torque signal based on the first requested motor torque signal and the new requested motor torque signal.

14. The motor assembly of claim 10, wherein the microphone is adjacent to the rotating member and in communication with the controller, and wherein the determining the first frequency of the first noise component comprises detecting the first noise component at the microphone.

15. The motor assembly of claim 10, wherein directing the rotation of the motor comprises modulating voltage through the motor at a three-phase inverter.

16. The motor assembly of claim 10, wherein generating the modified motor torque signal comprises adding the first requested motor torque signal and the new requested motor torque signal.

17. The motor assembly of claim 10, wherein the motor and the rotating member are coaxial with each other.

18. The motor assembly of claim 10, wherein the rotating member is a fan.

* * * * *